US007185570B2

(12) United States Patent
Hsieh

(10) Patent No.: US 7,185,570 B2
(45) Date of Patent: Mar. 6, 2007

(54) SPANNER WITH ENHANCING STRUCTURE FOR POSITIONING ELECTRONIC DEVICES INSTALLED THEREIN

(76) Inventor: Chih-Ching Hsieh, 235 Chung - Ho Box 8-24, Taipei (TW)

( * ) Notice: Subject to any disclaimer, the term of this patent is extended or adjusted under 35 U.S.C. 154(b) by 76 days.

(21) Appl. No.: 11/036,702

(22) Filed: Jan. 18, 2005

(65) Prior Publication Data

US 2006/0156874 A1 Jul. 20, 2006

(51) Int. Cl.

| | |
|---|---|
| ***B25B 23/14*** | (2006.01) |
| *B25B 23/142* | (2006.01) |
| *B25B 23/159* | (2006.01) |
| *B25B 23/16* | (2006.01) |
| *B25G 1/00* | (2006.01) |

(52) U.S. Cl. ..... 81/467; 81/478; 81/177.1

(58) Field of Classification Search ..... 81/467, 81/478–483, 177.1

See application file for complete search history.

(56) References Cited

U.S. PATENT DOCUMENTS 4,535,659 A * 8/1985 Yang ..... 81/478
6,463,811 B1 * 10/2002 Putney ..... 73/862.21

* cited by examiner

*Primary Examiner*—Lee D. Wilson
*Assistant Examiner*—Alvin J. Grant

(57) ABSTRACT

A spanner with an enhancing device for positioning electronic devices installed therein; a spanner having a holding portion; at least one end of the holding portion having a driving portion; each of the connection of the driving portion and the holding portion having a strain gauge; a receiving space before formed in the holding portion; an enhancing rib being installed in the receiving space; each of an upper side and lower side of the receiving space of the holding portion having an electric device; the two electric devices being placed at two sides of the enhancing rib; the electric devices being connected to the respective strain gauges for measuring changes of resistances of the of the strain gauges as forces are applied to the strain gauges so as to calculate the twisting forces and display the values of the twisting forces.

3 Claims, 3 Drawing Sheets

SPANNER WITH ENHANCING STRUCTURE FOR POSITIONING ELECTRONIC DEVICES INSTALLED THEREIN

FIELD OF THE INVENTION

The present invention relates to spanners, and in particular to a spanner with an enhancing structure for positioning electronic devices installed therein, wherein the enhancing structure provides a structure which causes the electric devices to be firmly secured thereon.

BACKGROUND OF THE INVENTION

In the present invention, an electronic spanner body has a holding portion. At least one end of the holding portion has a driving portion. A strain gauge is installed in the spanner body. A receiving space is formed in the holding portion. An upper side and lower side of the receiving space of the holding portion 10 receive electric devices 31, respectively. The electric devices 31 serve to measure the twisting force of the strain gauge 30 as forces are applied to the strain gauges 30 so as to display the value of the twisting forces. Thereby the user can view the twisting value at the two sides.

However the prior art electronic spanner has a flat holding portion and two electric devices are placed in a hole in the holding portion. Thereby the structural strength of the spanner is weakened. The spanner is used to screw a screw object by lever principle. The holding portion is a portion to apply a force to the screw means. Thereby the prior art structure will cause the holding portion to break easily. The electric devices have no proper supporter so that they easily fall out from the spanner due to the operation of the spanner or the electric devices are destroyed so that the twisting force cannot be displayed.

SUMMARY OF THE INVENTION

Accordingly, the primary object of the present invention is to provide a spanner with an enhancing structure for positioning electronic devices installed therein, wherein the enhancing structure provides a structure which causes the electric devices to be firmly secured thereon.

To achieve above objects, the present invention provides a spanner with an enhancing device for positioning electronic devices installed therein; a spanner having a holding portion; at least one end of the holding portion having a driving portion; each of the connection of the driving portion and the holding portion having a strain gauge; a receiving space being formed in the holding portion; an enhancing rib being installed in the receiving space; each of an upper side and lower side of the receiving space of the holding portion having an electric device; the two electric devices being placed at two sides of the enhancing rib; the electric devices being connected to the respective strain gauges for measuring changes of resistances of the of the strain gauges as forces are applied to the strain gauges so as to calculate the twisting forces and display the value of the twisting forces.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
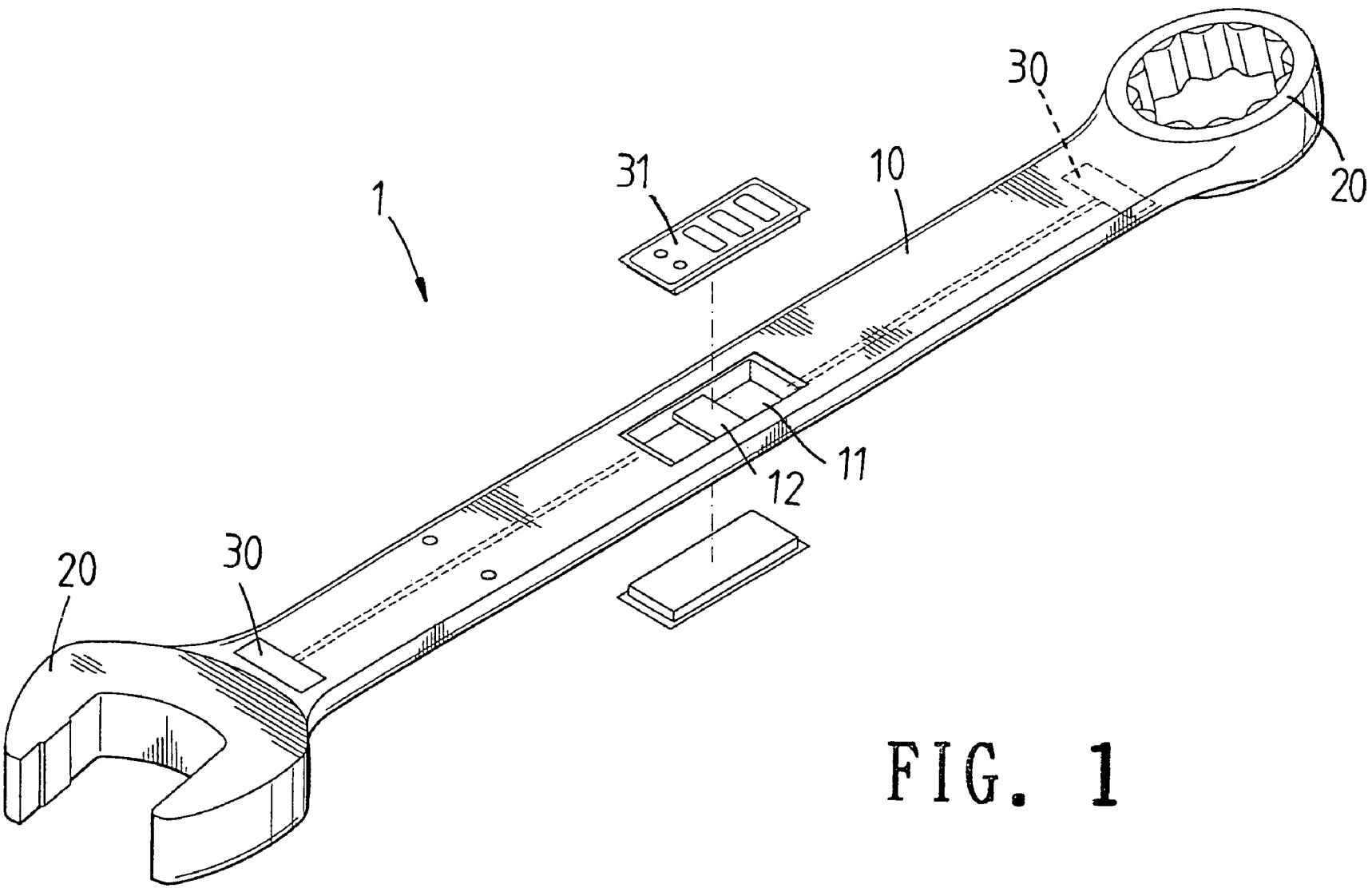
FIG. 1 is an exploded perspective view of the spanner with an enhancing structure for positioning electronic devices installed therein according to the present invention.
Figure 2:
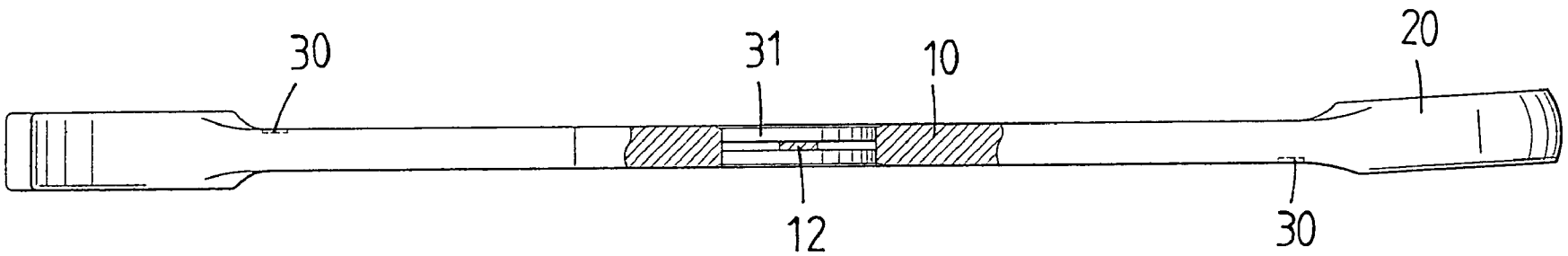
FIG. 2 is a cross sectional view about the spanner with an enhancing structure for positioning electronic devices of the present invention installed therein.
Figure 3:
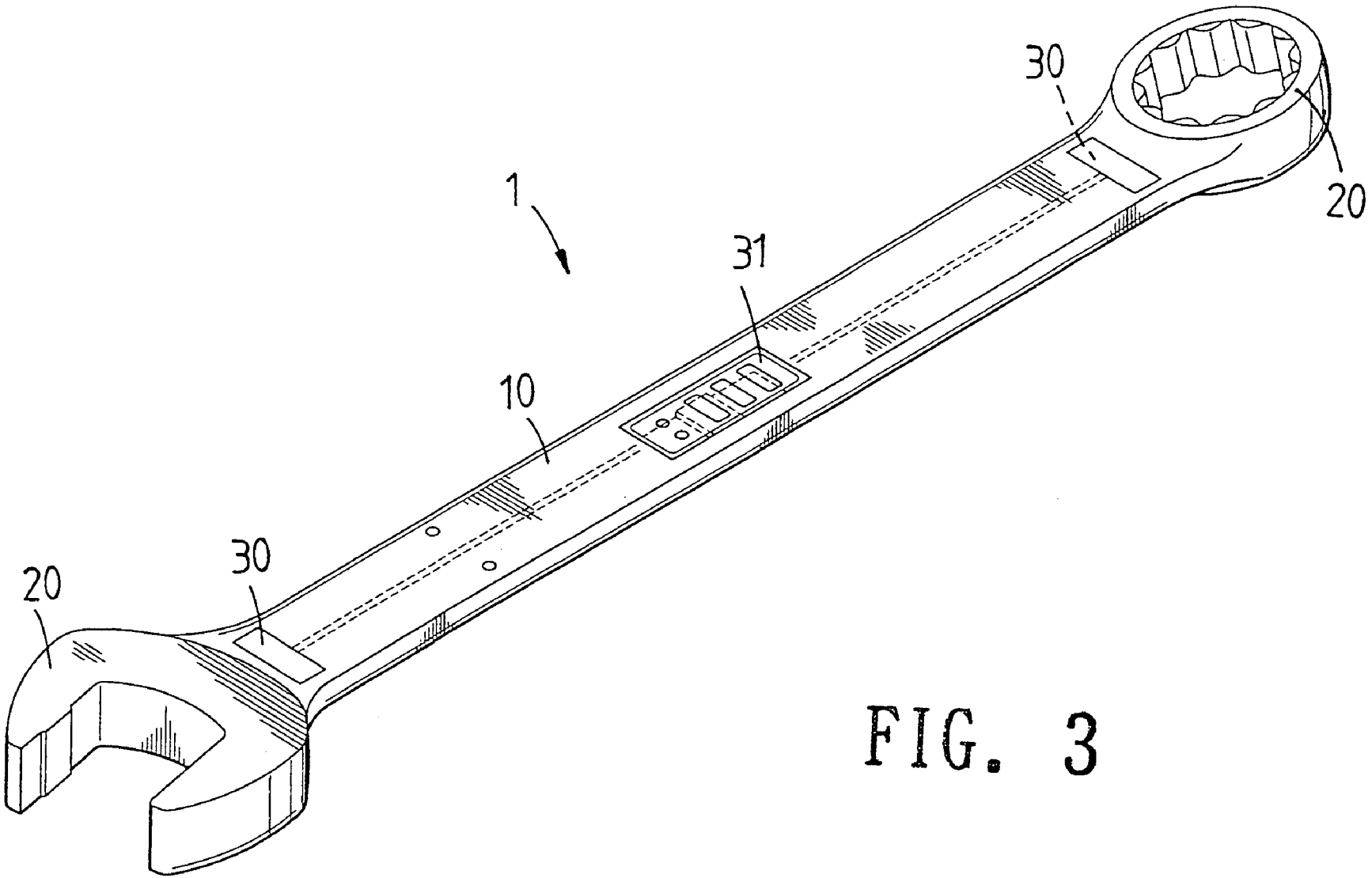
FIG. 3 is an assembled view of the present invention.

Referring to FIGS. 1 to 3, the enhancing structure of an electronic spanner is illustrated. The present invention has the following elements.

A spanner body 1 has a holding portion 10. At least one end of the holding portion 10 has a driving portion 20. Each of the connection of the driving portion 20 and the holding portion 10 has a strain gauge 30. A receiving space 11 is formed in the holding portion 10. An enhancing rib 12 is installed in the receiving space 11. An upper side and lower side of the receiving space 1 of the holding portion 10 receive electric devices 31, respectively. The two electric devices 31 are placed at two sides of the enhancing rib 12. The electric devices 31 are connected to the respective strain gauges 30. The electric devices 31 serve to measure the changes of the resistances of the of the strain gauge 30 as forces are applied to the strain gauges 30 so as to calculate the twisting forces and display the values of the twisting forces.

In the present invention, the two electric devices are connected to a same strain gauge or the two electric devices are connected to different strain gauges.

In the present invention, the enhancing rib 12 not only increases the structural strength of the holding portion 10, but also has the effect of preventing a too large deformation of the receiving space 11 so as to harm the electric devices 31 and have the effect of receiving and positioning the electric devices 31 so that the two electric devices 31 are separated from one another with a predetermined distance. Thereby the two electric devices 31 will not interfere with one another.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spanner with an enhancing structure for positioning electronic devices installed therein; the spanner having a holding portion; at least one end of the holding portion having a driving portion; each of the connection of the driving portion and the holding portion having a strain gauge; a receiving space being formed in the holding portion; an enhancing rib being installed in the receiving space; each of an upper side and lower side of the receiving space of the holding portion having an electric device;

opposite sides of the enhancing rib having one of the electric devices; the electric devices being connected to the respective strain gauges for measuring changes of resistances of the of the strain gauges as forces are applied to the strain gauges so as to calculate the twisting forces and display the values of the twisting forces.

2. The spanner as claimed in claim 1, wherein the two electric devices are connected to a same strain gauge.

3. The spanner as claimed in claim 1, wherein the two electric devices are connected to different strain gauges.

* * * * *